US006782641B2

(12) United States Patent
Turner et al.

(10) Patent No.: US 6,782,641 B2
(45) Date of Patent: Aug. 31, 2004

(54) HEEL CONSTRUCTION FOR FOOTWEAR

(75) Inventors: Jerome A. Turner, Irvine, CA (US); John W. Thomas, Irvine, CA (US)

(73) Assignee: American Sporting Goods Corporation, Irvine, CA (US)

( * ) Notice: Subject to any disclaimer, the term of this patent is extended or adjusted under 35 U.S.C. 154(b) by 80 days.

(21) Appl. No.: 10/218,084

(22) Filed: Aug. 12, 2002

(65) Prior Publication Data

US 2004/0025375 A1 Feb. 12, 2004

(51) Int. Cl.[7] ..... A43B 13/20; A43B 13/41; A43B 13/12

(52) U.S. Cl. ..... 36/29; 36/35 B; 36/30 R

(58) Field of Search ..... 36/27, 35 B, 30 R, 36/31, 141, 29

(56) References Cited

U.S. PATENT DOCUMENTS

| | | | | | |
|---|---|---|---|---|---|
| 4,610,099 | A | * | 9/1986 | Signori | 36/29 |
| 4,817,304 | A | * | 4/1989 | Parker et al. | 36/29 |
| 5,005,300 | A | * | 4/1991 | Diaz et al. | 36/31 |
| 5,930,918 | A | * | 8/1999 | Healy et al. | 36/29 |
| 5,952,065 | A | * | 9/1999 | Mitchell et al. | 36/30 R |
| 5,979,078 | A | * | 11/1999 | McLaughlin | 36/29 |
| 6,009,637 | A | * | 1/2000 | Pavone | 36/29 |
| 6,055,746 | A | * | 5/2000 | Lyden et al. | 36/29 |
| 6,258,421 | B1 | * | 7/2001 | Potter | 36/29 |
| 6,391,405 | B1 | * | 5/2002 | Bonk et al. | 36/29 |
| 6,457,262 | B1 | * | 10/2002 | Swigart | 36/29 |
| 6,457,263 | B1 | * | 10/2002 | Rudy | 36/29 |
| 6,463,612 | B1 | * | 10/2002 | Potter | 36/29 |

FOREIGN PATENT DOCUMENTS

| | | | | |
|---|---|---|---|---|
| WO | WO 87/03789 | * | 7/1987 | A43B/13/20 |
| WO | WO 93/18677 | * | 9/1993 | A43B/13/18 |

* cited by examiner

*Primary Examiner*—Anthony Stashick
(74) *Attorney, Agent, or Firm*—Michael A. Painter

(57) ABSTRACT

The present invention comprises a multilayered heel construction for footwear. A fluid-filled bladder is incorporated into the heel of footwear. The bladder defines an internal cavity which is adapted to enclose a fluid at atmospheric pressure. The internal cavity defines a peripheral channel adjacent the periphery of the bladder and a plurality of intersecting channels orientated transversely to the longitudinal axis of the footwear. The intersecting channels are in communication with the peripheral channel of the interior cavity. The bladder is positioned at the heel of the footwear and is positioned intermediate an upper footbed support. The lower surface of the multilayered heel assembly defines a concave, cantilever surface. The combination of the bladder, the upper footbed support and the lower cantilever surface improve shock absorption and the stability of the footwear.

6 Claims, 9 Drawing Sheets

HEEL CONSTRUCTION FOR FOOTWEAR

BACKGROUND OF THE INVENTION

1. Field of the Invention

The present invention generally relates to footwear construction and in particular to the use of shock absorption and stabilizing members incorporated into the heel portion of the midsole of the footwear defined by a fluid-filled bladder in combination with a lower concave, shock absorbing cantilever support surface.

2. Prior Art

The result of the increased popularity of exercise, as well as the necessities of everyday walking and standing, it has been recognized there is a need to alleviate and relieve the stress imposed on a person's feet and legs. In particular, it is essential that shoes and other like footwear provide for suitable shock absorption and stability. This is particularly important where the shoes or footwear are to be used in active pursuits such as running or other athletic endeavors.

As a general rule, it is the midsole of a shoe that provides the cushioning and stability to the foot of a user. In conventional shoes used for athletic purposes, either polyurethane foam, EVA (ethyl vinyl acetate) foam or perhaps HYTREL foam is used as the material which provides most of the cushioning of the shoe (HYTREL is a trademark of DuPont de Numerus & Co.). As stated, advanced shock absorption and stability is particularly required in athletic footwear where the user's foot is exposed to repeated shocks from footstep impact in running and other athletic activities.

The prior art discloses a variety of footwear designs which have been developed for the purpose of improving shock absorption and stability. These prior art designs range from merely constructing the shoe sole from a softer, more resilient material to incorporating fluid-filled pads or bladders in the midsole of a shoe. In many shoe midsoles designed to increase the cushioning effects of the shoe, the increased resiliency or softness of the shoe sole provides no resistance to the tendency of the user's foot to rotate relative to the leg upon impact, a condition generally referred to as pronation. The tendency for excessive lowering of the medial margin of the foot or excessive pronation, and a tendency for an excessive raising of the medial margin of the foot, or supination, have the potential of causing injuries to the wearer of the shoe.

One of the footwear designs disclosed by the prior art comprises a pair of tabs extending from opposite sides of the outsole of the shoe to the heel counter of the shoe for the purpose of connecting the outsole to the heel counter and increasing the lateral medial stability of the shoe. In this design, the tabs are formed as an integral part of the shoe outsole and are bonded to a heel wedge layer and midsole layer of the shoe sole as well as the heel counter. The inadequacy of this design is inherent in its construction. Since the tabs are secured to the extreme outer edges of the heel wedge and midsole, this will reduce the ability of the tabs to resist compression of the heeled wedge and midsole in the areas of the wedge and midsole inside the shoe surrounding the user's foot.

Another design for footwear disclosed by the prior art employs one or more shock absorbers embedded within the heel portion of the midsole. The shock absorbers are typically air or fluid filled cylinders which can absorb the force of the heel and then return the energy in a controlled upward direction. Irrespective of the number of fluid filled cylinders embedded within the heel, excessive pronation of the user's foot will occur since the air cylinders cannot properly respond to the difference in forces imposed on the medial and lateral portions of the heel.

The present invention resolves the inadequacies of the devices taught by the prior art. A footbed support platform is disposed beneath the heel and arch of the midsole. A fluid-filled bladder is disposed adjacent the bottom surface of the upper footbed support in the heel portion of the midsole. The bladder defines an interior, sealed cavity and comprises a peripheral channel which is positioned adjacent the periphery of the bladder and a plurality of transversely oriented channels which intersect with the peripheral channel of the sealed bladder. The bladder cavity is pressurized to atmospheric pressure. The upper surface of the bladder is adapted to snugly engage the bottom surface of the footbed support platform. The lower surface of the heel assembly defines a concave cantilever surface substantially bisected by the longitudinal axis of the heel section of the footwear. The combination of the footbed support platform, the fluid-filled bladder and the lower concave, cantilever surface provides improved shock absorption and stability to footwear.

SUMMARY OF THE INVENTION

The present invention relates to a multilayered structural assembly for the sole of footwear which improves shock absorption and stability. The midsole of the footwear has heel, midfoot and forefoot regions and an upper and lower surface. A footbed support platform is disposed adjacent the bottom surface of the midsole to the midfoot region which is commonly known as the arch. The lower surface of the footbed support platform is adapted to receive and be placed adjacent fluid-filled bladders which includes an internal, sealed cavity which is pressurized to ambient pressure. The fluid, preferably air, is disposed within the sealed cavity which is defined by a peripheral channel and a plurality of parallel, intersecting channels which are disposed substantially perpendicular to the longitudinal axis of the heel regions of the footwear. The intersecting channels are in communication with one another and the peripheral channel of the sealed cavity. The lower element of the heel assembly defines a concave, cantilever surface which is depressed when force is imposed upon the heel of the midsole. The combination of the footbed support platform, the fluid-filled bladder and the lower support element incorporating a cantilever surface provides improved shock absorption and stability.

It is an object of the present invention to provide construction for footwear which improves shock absorption and stability.

It is another object of the present invention to provide improved shock absorption and stability for shoes through the use of cooperating shock absorbing elements.

It is still another objection of the present invention to provide improved shock absorption for shoes through the use of a pressurized, fluid-filled bladder disposed within the heel region of the footwear.

It is still yet another object of the present invention to provide improved, dynamic stability for a shoe through the use of a cooperating fluid-filled bladder and a deflectable support platform in the heel region of the footwear.

It is still yet another object of the present invention to provide footwear incorporating an improved shock absorption and stability system which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
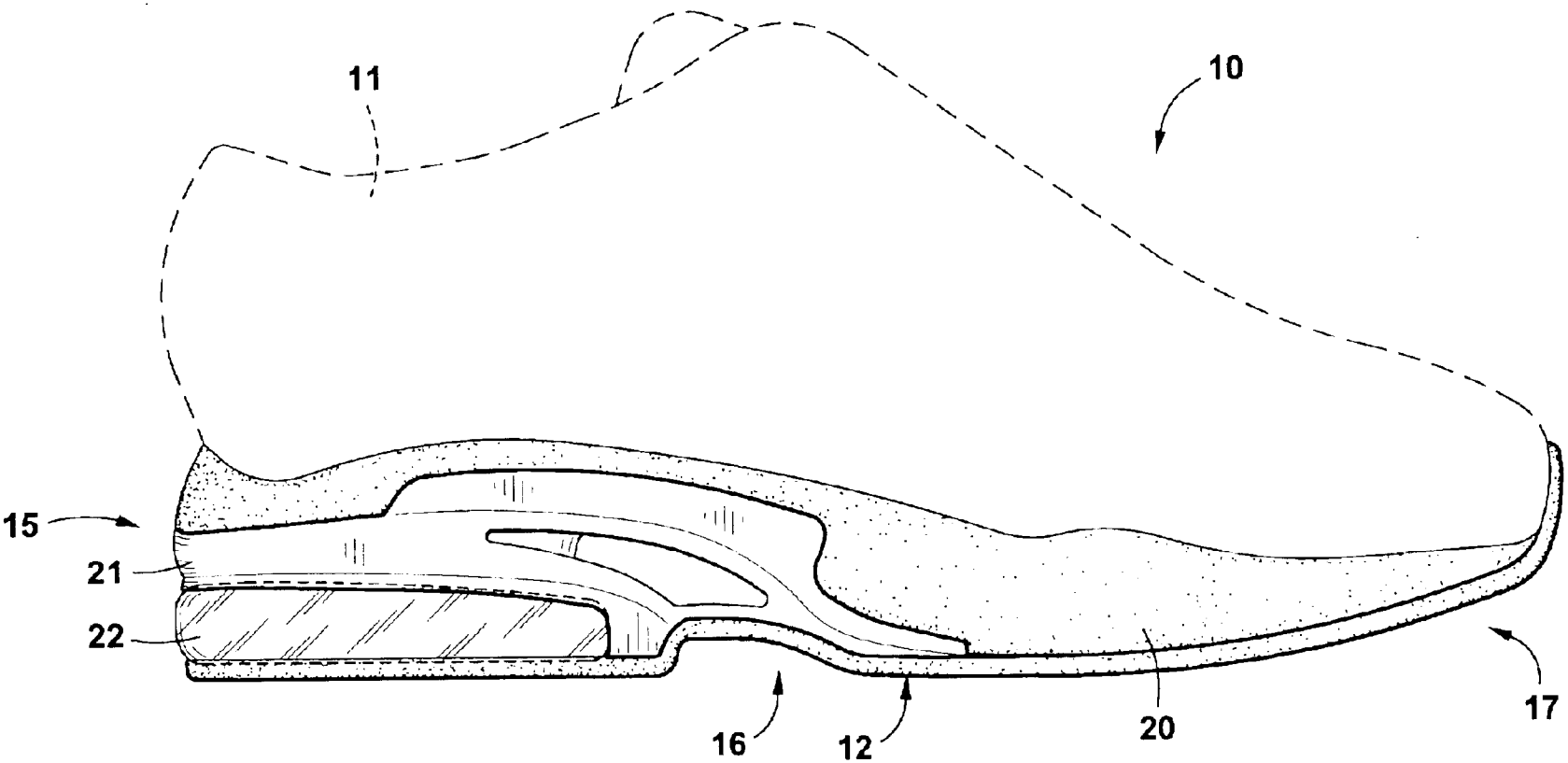
FIG. 1 illustrates a side elevation view of the first embodiment of a midsole assembly in accordance with the present invention.

An understanding of the preferred embodiment of the present invention can be best gained by reference to FIG. 1 which illustrates the medial side of a shoe for use on the left foot of a user. The right shoe incorporating the present invention would be a mirror image of that shown in FIG. 1. A shoe 10 is shown having an upper 11 and a sole 12. Shoe 10 includes a medial side 13 and lateral side 14 (see FIG. 2), a heel region 15, a midfoot region 16 and a forefoot region 17. The midfoot region is generally referred to as the arch.

The upper 11 used in conjunction with the present invention may be any conventional shoe upper including an upper that might be found in an athletic shoe. Although the description of the present invention is directed toward athletic shoes, such as shoes used for running, basketball, aerobics and the like, it is understood the present invention may be incorporated into street shoes or boots such as hiking boots. Upper 11 is attached to sole 12 in any conventional manner customary in the art.

Figure 2:
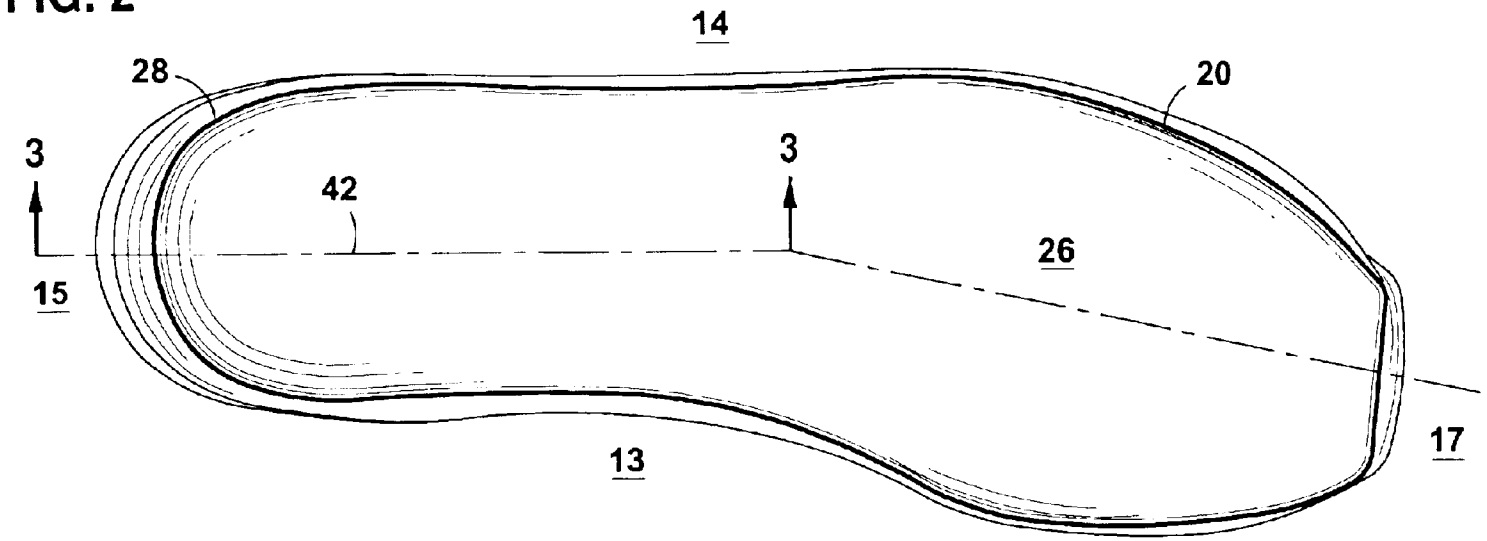
FIG. 2 constitutes a top plan view of the midsole shown in FIG. 1.

Sole 12 is formed of a plurality of components including a midsole 20, footbed support platform 21, a pressurized bladder 22 and an outsole 50. Midsole 12 may be made from any conventional cushioning materials such as polyurethane or ethyl vinyl acetate. Footbed support platform 21 is a resilient, deflectable element typically fabricated from polyurethane. Pressurized bladder 22 is fabricated from a flexible material which is impervious to the passage of a fluid such as air. Midsole 12 extends from the heel region 15 to the forefoot region 17 of shoe 10. As shown in FIG. 2, the upper surface 22 is adapted to receive and serve as the footbed for the foot of the user. The peripheral edge of top surface 26 is extended upwardly along its outer margin 28 to create a surface which will maintain the positioning of the user's foot and prevent inadvertent lateral movement thereof.

Figure 3:
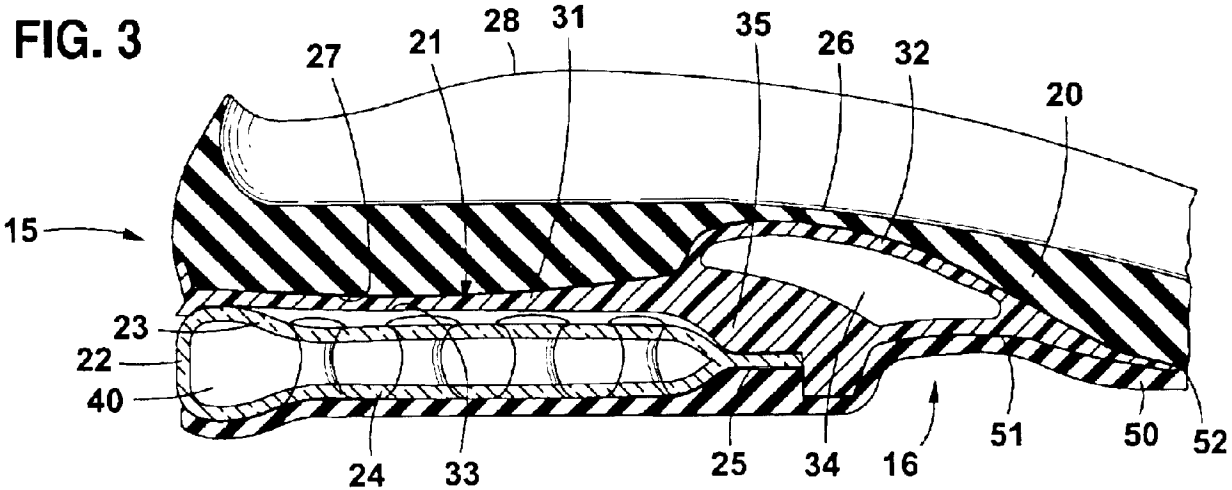
FIG. 3 illustrates a partial, enlarged cross-sectional view of the midsole shown in FIG. 1 and FIG. 2 taken through line 3—3 of FIG. 2.
Figure 5:
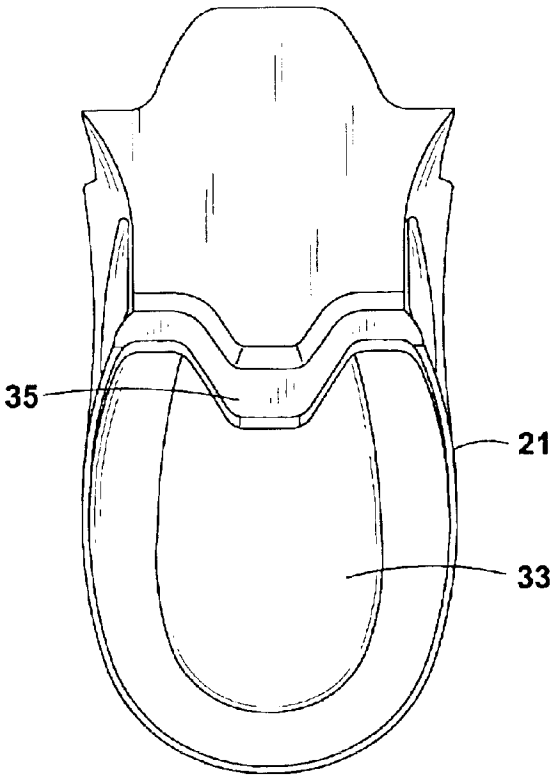
FIG. 5 illustrates a bottom plan view of the footbed support platform shown in FIG. 1 and FIG. 3.
Figure 4:
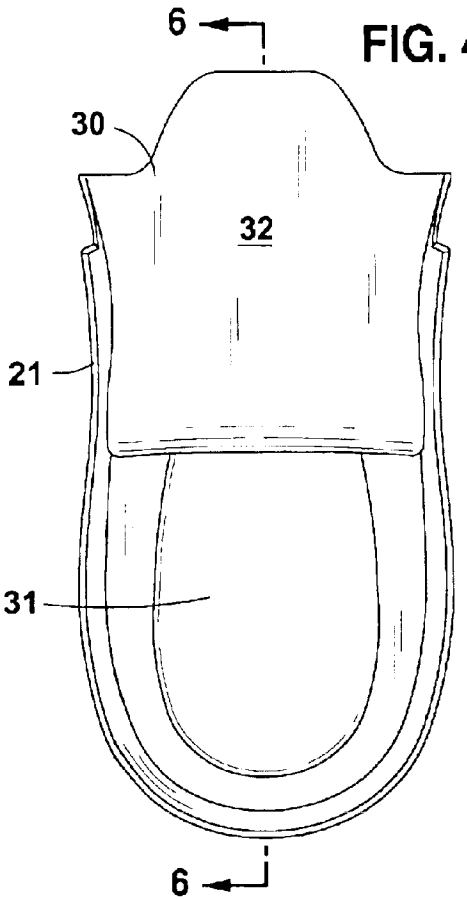
FIG. 4 illustrates a top plan view of the footbed support platform shown in FIG. 1 and FIG. 3.

Footbed support platform 21 (FIG. 3) is disposed adjacent the bottom surface 27 of midsole 20 and extends from the heel region 15 to the midfoot region 16. The structure of footbed support platform 21 can be best seen by FIGS. 3, 4, 5 and 6. The upper surface 30 of footbed support platform 21 comprises a heel receiving surface 31 which is positioned adjacent the lower surface 27 of midsole 20 in heel region 15 and an arch receiving surface which is positioned adjacent the midsole at midfoot region 16. The engagement between heel receiving surface 31 and lower surface 27 of midsole 20 provides support for the heel of the user's foot. Bottom surface 33 of footbed support platform 21 is adapted to engage fluid filled bladder 22 (see FIG. 3).

Figure 6:
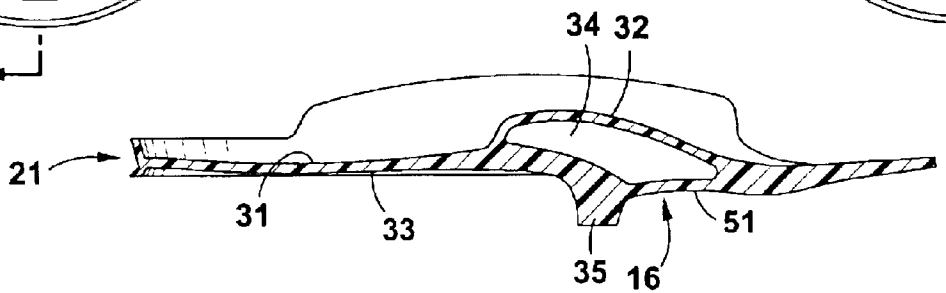
FIG. 6 illustrates a cross-sectional view of the footbed support platform shown in FIG. 4 taken through line 6—6 of FIG. 4.

As can be seen in FIG. 6, aperture 34 is laterally disposed through the midfoot platform 32. The absence of structural support beneath midfoot platform 32 provides a resilient surface at midfoot region 16. When the foot of the user imposes a downwardly directed force at midfoot surface 32, the latter will be deflected thereby absorbing a substantial proportion of the shock associated with foot strike.

Figure 7:
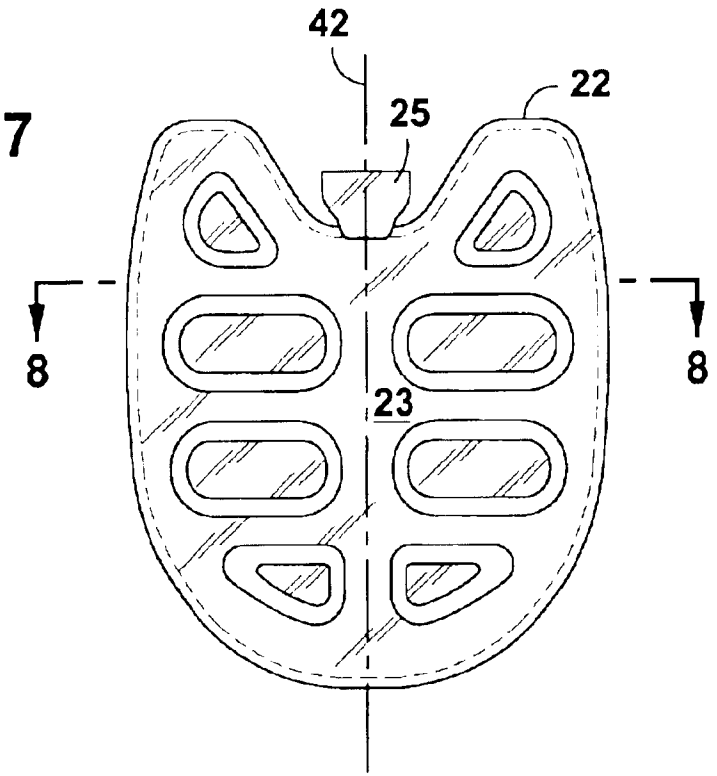
FIG. 7 illustrates a top plan view of the bladder illustrated in FIG. 1 and FIG. 3.
Figure 8:
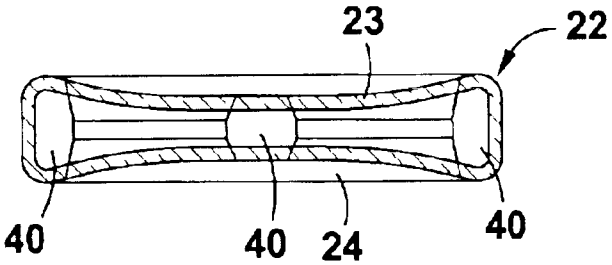
FIG. 8 illustrates a cross-sectional view of the bladder shown in FIG. 7 taken through line 8—8 of FIG. 7.

As set forth hereinabove, the present invention heel construction improves the stability and shock absorption capabilities of the footwear through the use of a sealed, pressurized bladder 22. The construction of the preferred embodiment for bladder 22 can be best seen by references to FIGS. 3, 7 and 8. Bladder 22 is constructed of an elastomeric material which is impervious to the passage of a fluid in general, and air in particular. Bladder 22 is defined by an upper surface 23 and a lower surface 24 which enclose sealed cavity 40. As can be best seen in FIG. 8, top and bottom surfaces 23 and 24 of bladder 22 are concave in profile, the minimum distance between concave surfaces 23 and 24 being along longitudinal axis 42. As will be explained in detail hereinbelow, the concave surface 24 creates a cantilever surface which is deformable upon the imposition of force in heel region 15 and thereby improves shock absorption characteristics.

Upper surface 23 of bladder 22 is disposed adjacent the convex bottom surface 33 of upper support platform 22. The intimate nesting of surfaces 33 and 23 maintain the relative position of bladder 22 and the heel region 15 of upper support platform 21. To further stabilize the relationship, upper and lower surfaces 23 and 24 converge into flange 25 which is disposed along longitudinal axis 42. Flange 25 is positioned adjacent inset surface 35 of upper support platform 21.

The ability of the present invention to improve shock absorption is created by the cooperation of midsole 20, upper support platform 21 and pressurized bladder 22. An outsole pad 50 is coupled along the bottom surface 24 of pressurized bladder 22, and the forward portions 51 and 52 of upper support platform 21 and midsole 20, respectively. At heel region 15, outsole pad 50 follows the contour of lower concave surface 24 of bladder 22 creating a cantilever surface relative to the ground or other surface on which the footwear is to be employed. During a normal running gait cycle, the foot of the user will roll from heel strike, generally at the lateral side of heel region 15, to midfoot stance wherein the medial side of the sole makes contact with the ground. As stated, a primary purpose of the present invention is to improve shock absorption and prevent excessive pronation or supination by adapting to the different forces which may be imposed on the sole of the footwear. At heel strike, the force imposed by the heel on the midsole will be transmitted through lower surface 33 of upper support platform 21 to upper surface 23 of pressurized bladder 22. Bladder 22 is filled with a fluid at atmospheric pressure which is preferably air. The concave surface 23 stabilizes the force imposed cushioning the force and transmitting same to the lower cantilever surface 24 of bladder 22. Cantilever surface 24 will deform upon the imposition of the force at heel strike and will return to its quiescent state upon the progression of the running cycle.

Figure 9:
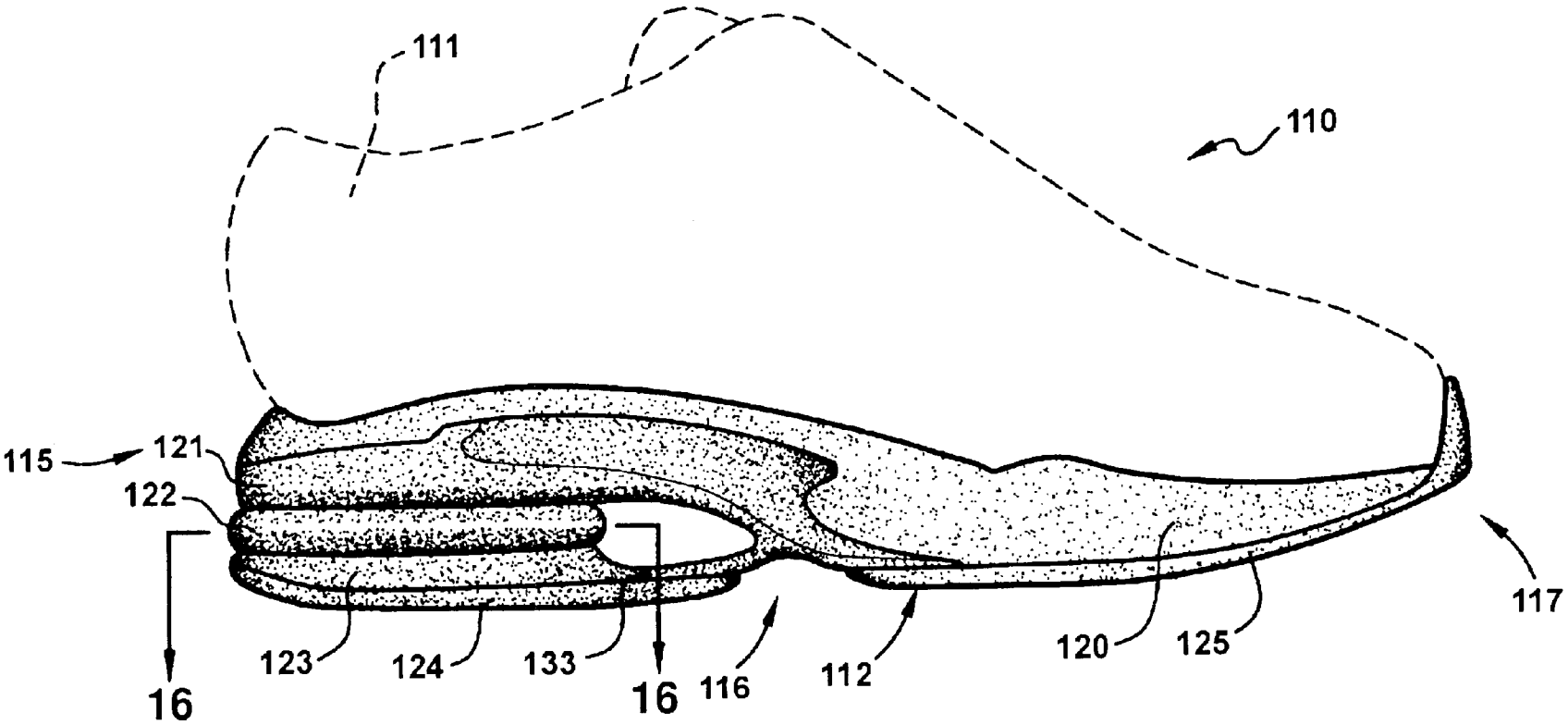
FIG. 9 illustrates a side elevation view of a shoe which employs a second embodiment of a midsole assembly in accordance with the present invention.
Figure 10:
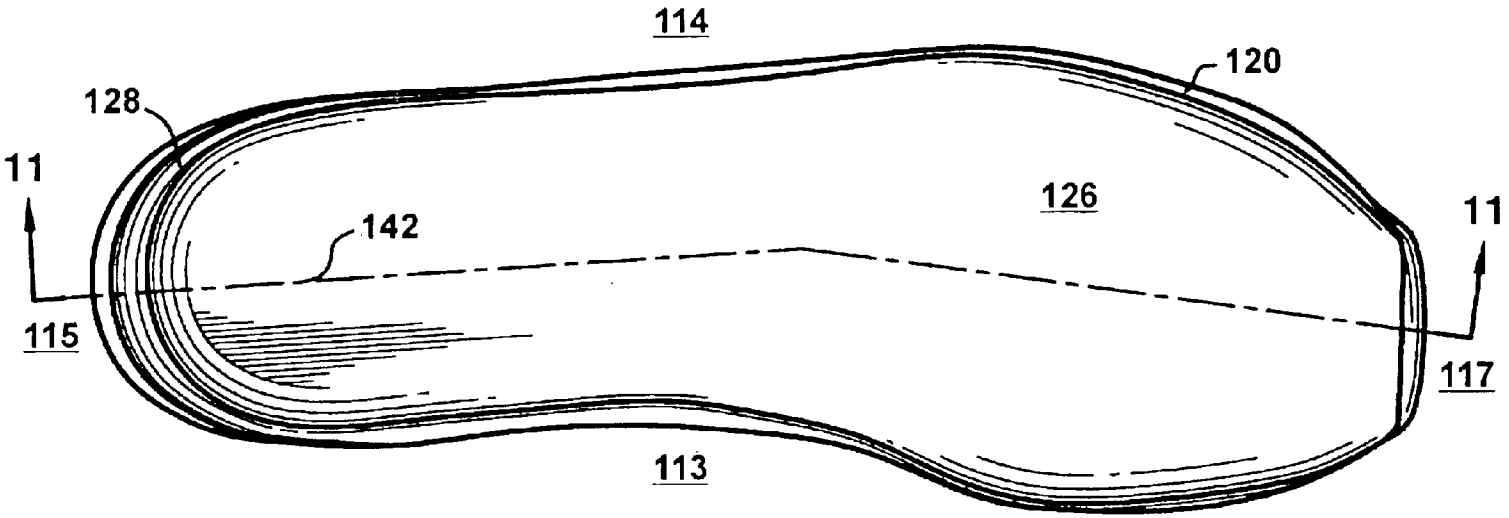
FIG. 10 constitutes a top plan view of the midsole shown in FIG. 9.

An understanding of a second embodiment of the present invention can be best gained by reference to FIG. 9 which illustrates the medial side of a shoe for use on the left foot of a user. The right shoe incorporating the present invention would be a mirror image of that shown in FIG. 9. A shoe 110 is shown having an upper 111 and a sole 112. Shoe 110 includes a medial side 113 and a lateral side 114 (see FIG. 10), a heel region 115, a midfoot region 116 and a forefoot region 117. The midfoot region is generally referred to as the arch. The upper 111 used in conjunction with the present invention may be any conventional shoe upper, including an upper that might be found in an athletic shoe.

Sole 112 is formed of a plurality of components including midsole 120, footbed support platform 121, pressurized bladder 122, lower support platform 123 and heel and forefoot outsole pads 124 and 125, respectively. Midsole 120 may be made from any conventional cushioning material such as polyurethane or ethyl vinyl acetate. Footbed support platform 121 and lower support platform 123 are resilient and deflectable elements typically fabricated from polyurethane. Pressurized bladder 122 is fabricated from a flexible material which is impervious to the passage of a fluid such as air.

Midsole 120 extends from the heel region 115 to the forefoot region 117 of shoe 110. The upper surface 126 is adapted to receive and serve as the footbed for the foot of the user. The peripheral edge of top surface 126 is extended upwardly along its outer margin 128 to create a surface which will maintain the positioning of the user's foot and prevent inadvertent lateral movement thereof. A footbed support platform 121 is disposed adjacent the bottom surface 127 of midsole 120 and extends from the heel region 115 to the midfoot region 116.

Figure 12:
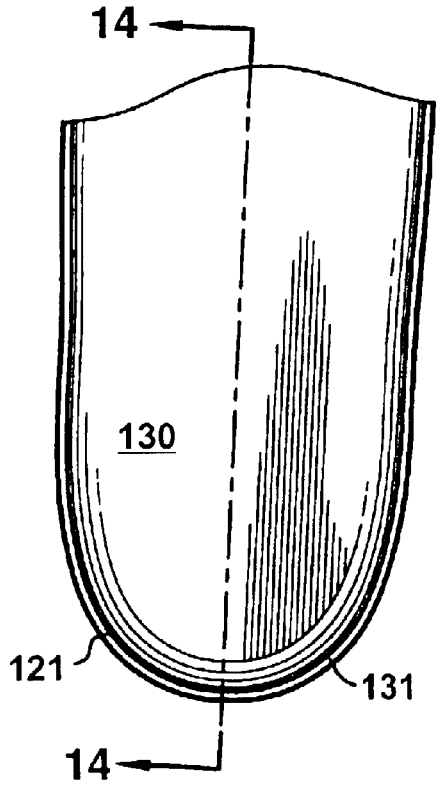
FIG. 12 illustrates a top plan view of the footbed support platform shown in FIG. 9.
Figure 13:
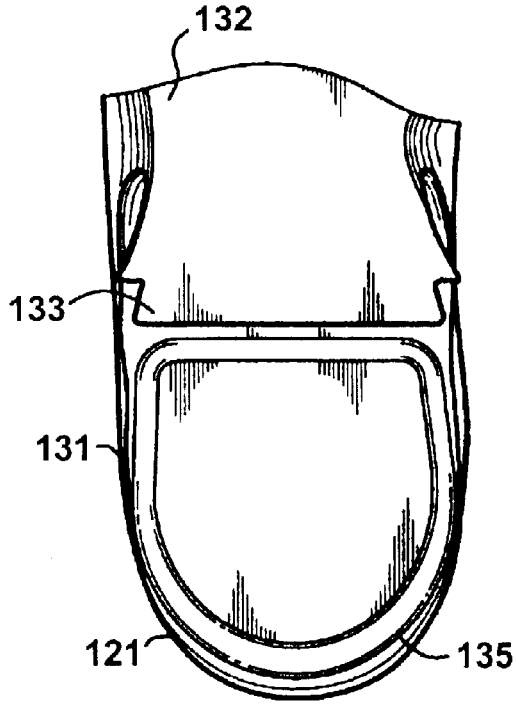
FIG. 13 illustrates a bottom plan view of the footbed support platform.
Figure 14:
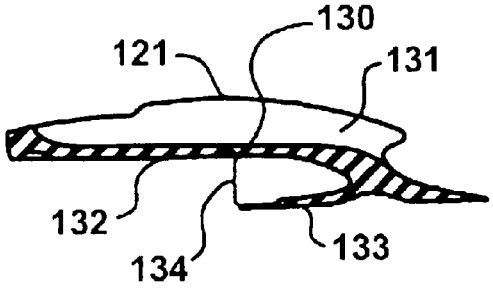
FIG. 14 is a cross-sectional view of the footbed support platform shown in FIG. 12 taken through line 14—14 of FIG. 12.

The structure of footbed support platform 121 can be best seen by FIGS. 12, 13 and 14. The upper surface 130 of footbed support platform 121 is adapted to fit firmly adjacent the bottom surface of midsole 120 between heel region 115 and midsole region 116. Upper surface 130 embodies a substantially planar central segment which depends upwardly into an outer margin 131 to provide support for the midsole in the medial and lateral regions of the heel of the user's foot. Bottom surface 132 of upper support platform 121 is adapted to engage fluid-filled bladder 122 and lower support platform 123 and to stabilized the position of these elements relative to footbed support platform 121.

Figure 11:
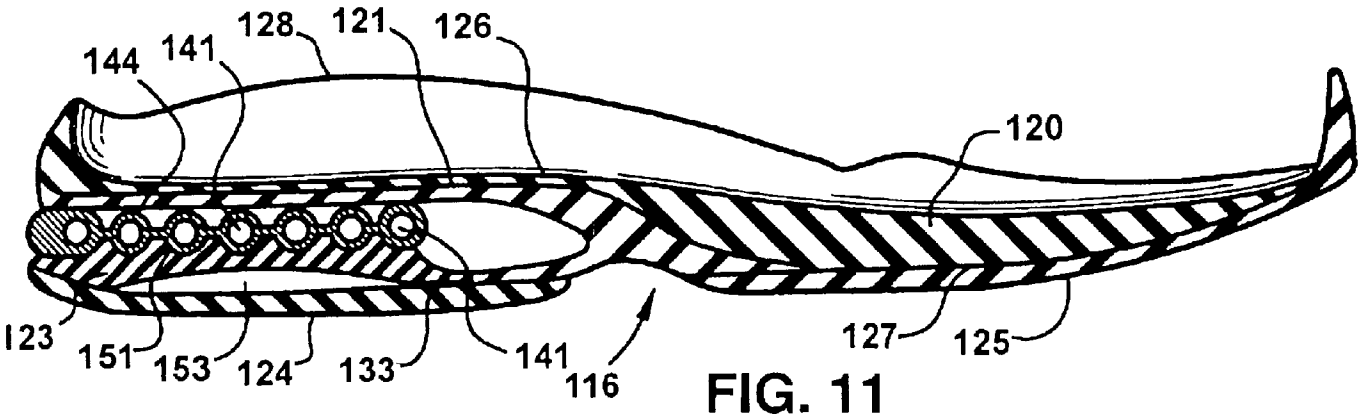
FIG. 11 illustrates a cross-sectional view of the midsole shown in FIG. 9 and FIG. 10 taken through lines 11—11 of FIG. 10.
Figure 15:
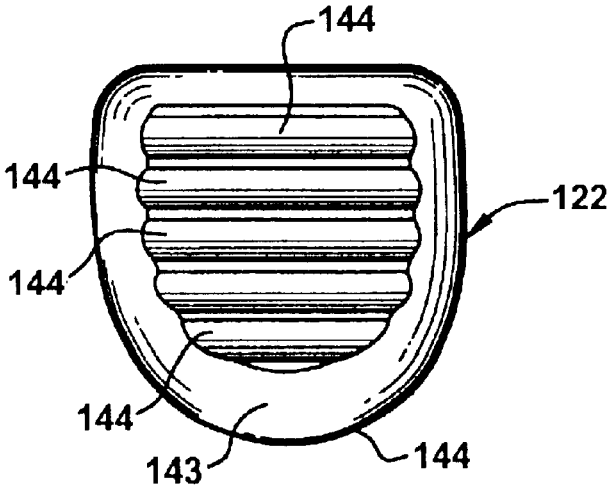
FIG. 15 illustrates a top plan view of the fluid-filled bladder shown in FIG. 9 and FIG. 11.

As can be best seen in FIG. 15, deflectable flange 133 extends rearwardly from lower surface 132 to create an opening 134 therebetween. Since upper support flange 121 is constructed of resilient, deflectable polyurethane or the like, in its unstressed state, the distance between the terminus of flange 133 and bottom surface 132 (i.e., opening 134) is less than the thickness of the assembly of fluid-filled bladder 122 and lower support platform 123. When fluid-filled bladder 122 and lower support platform 123 are adjacent one another and positioned between flange 133 and bottom surface 132 of upper support platform 121 as shown in FIG. 11, flange 133 will be deflected downwardly and a resilient force will be imposed on lower support platform 123 in a manner which will stabilize the position of bladder 122 and lower support platform 123. As will be described in detail hereinbelow, a channel 135 is formed in the bottom surface 132 in the heel region 115, channel 135 being adapted to be placed adjacent the periphery of bladder 122 and thereby further stabilize its position relative to upper support platform 121.

Figure 16:
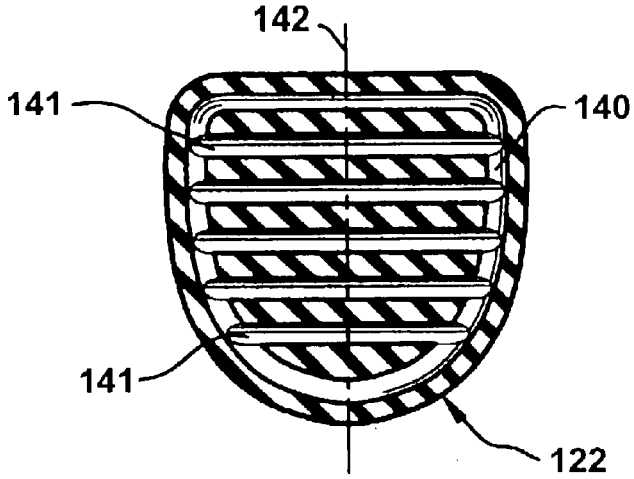
FIG. 16 illustrates a cross-sectional view of the fluid-filled bladder taken through line 16—16 of FIG. 9.
Figure 17:
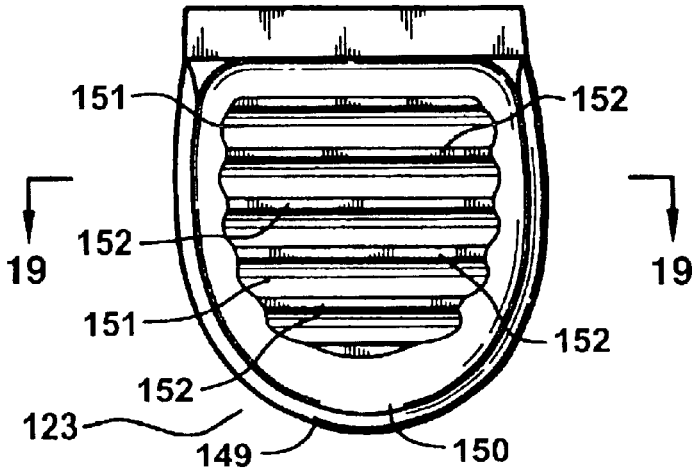
FIG. 17 illustrates a top plan view of the lower support platform shown in FIG. 9 and FIG. 11.

An understanding of the structure of bladder 122 can be best gained by reference to FIGS. 15, 16 and 17. Bladder 122 is constructed of an elastomeric material which is impervious to the passage of fluid. Bladder 122 defines an interior cavity 140 which includes a plurality of tubular elements 141 which are disposed transverse to the longitudinal axis 142 and are in communication with cavity 140. Cavity 140 is sealed and is adapted to maintain a fluid, preferably in the form of air, at atmospheric pressure.

FIG. 11 illustrates the upper and lower outer surfaces of bladder 122 which are mirror images of one another. Bladder 122 is intended to improve shock absorption. To meet this objective, the outer surfaces thereof are defined by a peripheral tubular surface 143 and a plurality of transverse tubular surfaces 144 which are in a substantially planar relationship to peripheral surface 143. As shown in FIG. 15, peripheral and tubular surfaces 143 and 144 of bladder 122 enclose cavity 140 and the tubular elements 141 which are in communication therewith.

Figure 18:
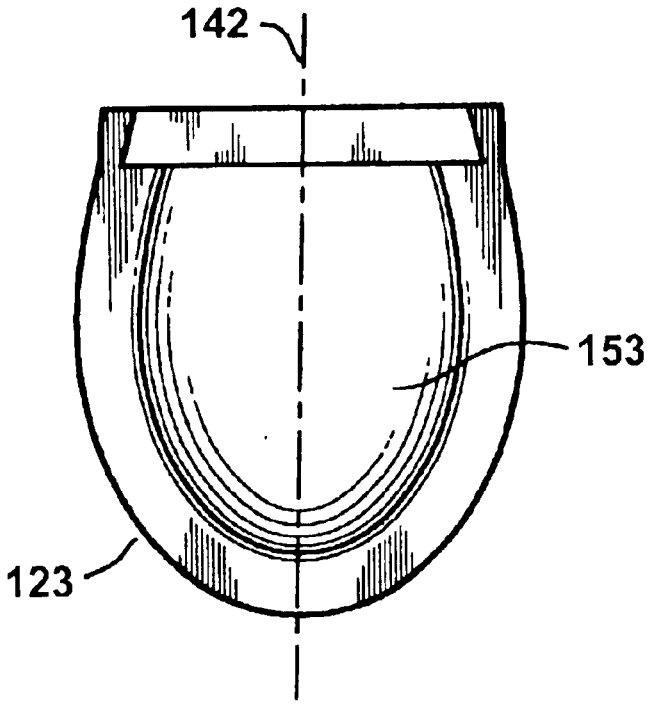
FIG. 18 illustrates a bottom plan view of the lower support platform.
Figure 19:
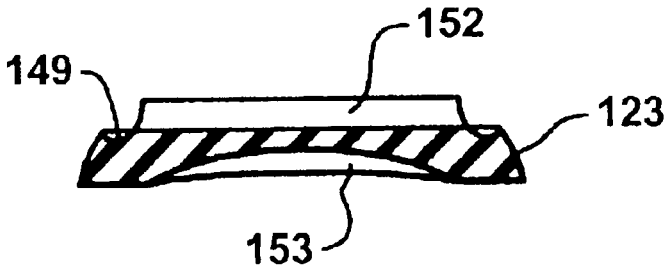
FIG. 19 illustrates a cross-sectional view of the lower support platform taken through line 19—19 of FIG. 17.

An understanding of the structure of lower support platform 123 can be best gained by reference to FIGS. 18 and 19. As shown in FIG. 11, lower support platform 123 is disposed adjacent the lower surface of bladder 122. The upper surface 149 of lower support platform 123 includes a concave, peripheral channel 150 and a plurality of transverse, concave tubular channels 151 which are reciprocal images of the bottom surface of bladder 122. Each pair of adjacent tubular channels 151 are separated by an elevated ridge 152. When assembled in the manner shown in FIG. 11, peripheral tubular surface 143 will be firmly nested adjacent peripheral channel 150. In a like manner, the tubular elements 141 will be firmly nested adjacent the transverse tubular surfaces 151. The elevated ridges 152 will contact the bottom surface of bladder 122 intermediate adjacent pairs of tubular surfaces 143. The interface between upper surface 149 of lower support platform 123 and the bottom surface of bladder 122 provides for stabilization between the two elements.

In the embodiment illustrated in FIGS. 9–19, inclusive, a primary objective of the present invention is achieved through the utilization of the structural feature depicted as part of the bottom surface of lower support channel 123. A concave depression 153 is disposed into the bottom surface of lower support platform 123. The longitudinal axis 142 of the heel region 115 generally bisects concave depression 153. The concave depression 153 is generally referred to as a cantilever surface. When the user's foot exerts a downward force on footbed support platform 121, it will cause compression of fluid-filled bladder 122 and cantilever surface 153. When force of the user's foot is removed, cantilever surface 153 will return to its quiescent, concave orientation. To achieve the objective of stabilization, upper support platform 121 extends fully through the heel region 115 of the sole and extends through the midfoot region 116. To further control pronation, it is understood the present invention contemplates an upper support platform 121 in which the hardness may be selectively increased in a specific region thereof, i.e., the medial region 113.

We claim:

1. A sole structure for footwear comprising:

a. a midsole formed of a shock absorbing material having a heel region, a midfoot region and a forefoot region and top and bottom surfaces;

b. footbed support means for stabilizing the position of the foot of the user disposed adjacent the bottom surface of the midsole and extending from the heel region to the forefoot region thereof;

c. a resilient bladder having top and bottom surfaces and defining a fluid-tight cavity, the top surface being disposed adjacent said footbed support means in opposition to the heel region of said midsole;

d. a volume of fluid being disposed within said cavity; and e. defectable, lower support platform having top and bottom surfaces extending forwardly from the heel region toward the midfoot region of the midsole, the top surface thereof being adjacent the bottom surface of said bladder, the bottom surface of said lower support platform centrally defining a concave, cantilever portion which is adapted to be downwardly deflectable upon the imposition of a downardly directed force upon the heel region of said midsole.

2. A sole structure for footwear as defined in claim 1 wherein said footbed support means comprises a deflectable panel having first and second portions, each of which has a top and bottom surface, the top surface of said first portion being in engagement with the bottom surface of the midsole from the heel region to the midfoot region thereof, the second portion extending rearwardly from said first portion at the midfoot region, the top surface of said second portion being spaced from the bottom surface of said first portion.

3. A sole structure for footwear as defined in claim 2 wherein said bladder includes a plurality of tubular elements in parallel spaced relation with each other, each of said tubular elements defining apertures therethrough which are in communication with each other and with the fluid-tight cavity.

4. A sole construction for footwear as defined in claims 1 wherein said fluid-tight cavity is pressurized to atmospheric pressure.

5. A sole structure as defined in claim 3 wherein the top surface of said lower support platform includes a plurality of transverse tubular surfaces in parallel spaced relation with each other, each of the tubular elements of said bladder being in engagement with a responsive one of the tubular elements of said bladder.

6. A sole structure as defined in claim 2 wherein the portion of the lower support platform toward the midfoot region of the midsole is disposed adjacent to and engaged with the second portion of the deflectable panel.

* * * * *